United States Patent [19]

Matsumoto et al.

[11] Patent Number: 4,765,879

[45] Date of Patent: Aug. 23, 1988

[54] DURABLE ELECTRODES FOR ELECTROLYSIS AND PROCESS FOR PRODUCING THE SAME

[75] Inventors: Yukiei Matsumoto, Kanagawa; Takayuki Shimamune, Tokyo, both of Japan

[73] Assignee: Permelec Electrode Ltd., Kanagawa, Japan

[21] Appl. No.: 56,635

[22] Filed: Jun. 2, 1987

[30] Foreign Application Priority Data

Jun. 2, 1986 [JP] Japan ..... 61-125702

[51] Int. Cl.[4] ..... C25C 7/02

[52] U.S. Cl. ..... 204/290 R; 204/290 F; 204/291; 204/292; 204/293; 427/419.1; 427/419.2; 427/419.7; 427/402; 427/405; 427/380

[58] Field of Search ..... 204/290 F, 290 R, 291–293, 204/35.1, 29, 37.1, 37.6, 38.1, 40; 427/419.1, 419.2, 419.3, 419.7, 436, 402, 405, 376.4, 376.6, 376.8, 380

[56] References Cited

U.S. PATENT DOCUMENTS

| | | | |
|---|---|---|---|
| 4,426,269 | 1/1984 | Brown et al. | 204/290 R |
| 4,568,568 | 2/1986 | Asano et al. | 204/290 R |
| 4,683,037 | 7/1987 | Duruz | 204/290 R |

*Primary Examiner*—R. L. Andrews

*Attorney, Agent, or Firm*—Sughrue, Mion, Zinn, Macpeak, and Seas

[57] ABSTRACT

An electrode for electrolysis which comprises an electrode substrate made of a conductive metal having thereon a coating of an electrode active substance is disclosed, in which a first intermediate layer comprising at least one compound of rare earth element and a second intermediate layer containing at least one of base metals and base metal oxides are provided between said electrode substrate and electrode active substance coating. The electrode exhibits high resistance to passivation and excellent durability, and is particularly suitable for use in electrolysis accompanied by oxygen generation and for organic electrolysis.

9 Claims, No Drawings

DURABLE ELECTRODES FOR ELECTROLYSIS AND PROCESS FOR PRODUCING THE SAME

FIELD OF THE INVENTION

This invention relates to an electode for electrolysis, and more particularly to an electrode having excellent durability in electrolysis accompanied by evolution of oxygen at the anode, and to a process for producing the same.

BACKGROUND OF THE INVENTION

Electrodes for electrolysis using valve metals, such as Ti, etc., as an electrode substrate are used as excellent insoluble metal electrodes in a variety of electrochemical fields. In particular, they have been widely put to practical use as chlorine-generating anodes in electrolysis of sodium chloride. Such valve metals includes Ti as well as Ta, Nb, Zr, Hf, V, Mo, W, etc.

These metal electrodes generally comprise metallic titanium coated with various electrochemically active substance, such as platinum group metals or oxides thereof as typically disclosed, e.g., in U.S. Pat. Nos. 3,632,498 and 3,711,385. They can hold a low chlorine overpotential for a long period of time, for particular use as electrodes for generation of chlorine.

However, when these metal electrodes are used as an anode in electrolysis for oxygen generation or in electrolysis for oxygen generation or in electrolysis accompanied by oxygen generation, the overpotential at the anode gradually increases. In extreme cases, passivation of the anode occurs, ultimately resulting in the failure of continuation of the electrolysis. Such passivation of the anode appears to arise mainly from reaction of the Ti substrate with oxygen from the oxide coating of the electrode itself or with oxygen from the electrolytic solution diffused and permeated through the electrode coating to thereby form titanium oxide that is a poor conductor. Further, since the poor conductor oxide is formed at the interface between the substrate and the electrode coating, it causes the coating to peel off, ultimately destroying the electrode.

Electrolytic processes wherein the anode product is oxygen or evolution of oxygen occurs as a side reaction are involved in many industrially important fields and include electrolysis using a sulfuric acid bath, nitric acid bath, an alkaline bath, etc.; electrolytic winning of Cr, Cu, Zn, etc.; various electroplating processes; electrolysis of a diluted saline solution, sea water, hydrochloric acid, etc.; organic electrolysis; electrolytic production of chlorates; and the like. However, the above-described problems have created problems in the application of the conventional metal electrodes to these fields.

In order to solve such problems, it has been proposed to provide a barrier composed of a Pt-Ir alloy or an oxide of Co, Mn, Pd, Pb, or Pt between the conductive substrate and the electrode coating, in order to prevent passivation of the electrode due to oxygen permeation as disclosed in Japanese Patent Publication No. 19429/76.

Although such an intermediate barrier is somewhat effective to prevent diffusion and permeation of oxygen during electrolysis, the material composing the barrier per se possesses a considerable electrochemical activity so that it is reacted with an electrolyte permeated through the electrode coating to form electrolytic products, such as gases, on the surface of the barrier. Such electrolytic products physically and chemically impair adhesion of the electrode coating, creating a potential problem that the electrode coating falls off before the expiration of the life of the electrode coating. In addition, the barrier has a problem of corrosion. Therefore, this proposal is still unsatisfactory for attaining sufficient durability of electrodes.

Another approach is an electrode having a laminated coating comprising a layer of an oxide of Ti, etc., and a layer of a platinum group metal or its oxide as described in Japanese Patent Publication No. 48072/74. However, when such an electrode is used for electrolysis involving oxygen evolution, passivation similarly takes place.

In an attempt to overcome these disadvantages, one of the inventors with others previously developed electrodes having an intermediate layer comprising an oxide of Ti or Sn and an oxide of Ta or Nb in which Pt may be dispersed, as disclosed in Japanese Patent Publication Nos. 22074/85 and 22075/85. These electrodes exhibit excellent conductivity and durability sufficient for practical application. Nevertheless, since the intermediate layer is formed by thermal decomposition, there remains room for further improvement with respect to denseness of the intermediate layer in order to enhance durability of the electrode.

SUMMARY OF THE INVENTION

One object of this invention is to provide an electrode having passivation resistance and sufficient durability such that it is particularly suitable for use in electrolysis accompanied by oxygen evolution or organic electrolysis.

Another object of this invention is to provide a process for producing such an electrode for electrolysis.

The electrode for electrolysis according to the present invention comprises an electrode substrate made of a conductive metal having thereon a coating of an electrode active substance, wherein a first intermediate layer comprising at least one compound of rare earth element and a second intermediate layer containing at least one of base metals and oxides thereof are provided between said electrode substrate and electrode active substance coating.

The intermediate layers according to this invention are corrosion-resistant, electrochemically inactive and have high denseness. They have a function of protecting an electrode substrate, e.g., Ti, against passivation without impairing conductivity of the substrate, combined with a function to bring about firm adhesion between the substrate and the electrode coating. Therefore, the electrodes of the present invention can sufficiently withstand use for electrolysis for oxygen generation, electrolysis accompanied by oxygen generation as a side reaction, and for electrolysis of an electrolytic solution containing organic compounds that has been found difficult to carry on with conventional metal electrodes.

DETAILED DESCRIPTION OF THE INVENTION

The electrode substrate which can be used in the present invention includes corrosion-resistant conductive metals, e.g., Ti, Ta, Nb, Zr, etc., and alloys based on these metals. Preferred among them are metallic Ti and Ti-based alloys, e.g., Ti-Ta-Nb, Ti-Pd, etc., that have been commonly employed.

Conductive metals having been subjected to known surface treatment, such as nitriding treatment, boriding treatment, or carbiding treatment, may also be employed as an electrode substrate. The electrode substrate may have any desired form, such as a plate form, a perforated plate form, a rod form, a net form, and the like.

According to the present invention, a first intermediate layer, a second intermediate layer, and an electrode active substance are then coated on the electrode substrate, in the order stated. It is preferable that the surface of the electrode substrate be subjected to washing, etching, or like pre-treatment prior to the coating.

The compound of rare earth element which can be used as the first intermediate layer can be selected from a wide range of compounds having various compound forms as long as they have corrosion resistance and conductivity and are capable of forming a dense coating film. In particular, oxides or oxyhalides of Sc, Y, La, Ce, Nd, Sm, or Gd, or a mixture thereof are preferred.

The first intermediate layer can be formed by dissolving a salt of the aforesaid rare earth element in a solvent therefor, coating the solution on the electrode substrate, dried and heating in air, etc., to effect thermal decomposition. As a result of heating in an oxidative atmosphere, an oxide of the rare earth element is generally formed. For example, upon heating is formed an oxyhalide of La, e.g., LaOCl, when using a hydrochloric acid solution of La, and is formed $La_2O_3$ when using a nitric acid solution of La.

The first intermediate layer may have an appropriately selected thickness depending on the kind and form of the rare earth element, but too large of a thickness tends to reduce conductivity. Therefore, a practical coverage is about 10 g/m$^2$ or less, based on the rare earth element content.

The second intermediate layer contains at least one of base metals and oxides thereof. The base metals and oxides thereof to be used preferably include Ti, Ta, Nb, Zr, Hf, W, V, Al, Si, Sn, Pb, Bi, Sb, Ge, In, Ga, Fe, Mo, and Mn and oxides thereof. These base metals and their oxides may be used either individually or in combinations thereof depending on the utility or use of conditions of the electrodes.

The base metals and/or oxides thereof may be combined with the aforesaid compounds of rare earth elements.

The second intermediate layer can be generally formed by coating a solution of a salt of the metal, followed by heating in a reductive or oxidative atmosphere to effect thermal decomposition. It may also be formed by other known techniques, such as plating, e.g., electroplating, electroless plating, etc., and vacuum deposition, e.g., CVD, PVD, etc.

The coverage of the second intermediate layer can be selected appropriately depending on the kind of the base metal used, and is preferably about 100 g/m$^2$ or less, based on the base metal content, for practical use.

Sufficient durability of electrodes cannot be assured if only one of the first intermediate layer and the second intermediate layer is formed. A marked improvement in durability can first be attained by the combination of these two intermediate layers.

Onto the substrate having the first and second intermediate layers is then coated an electrode active substance having electrochemical activities. The substance to be used for electrode coating is preferably selected from metals, metal oxides, and mixtures thereof which are excellent in electrochemical characteristics and durability according to the electrolytic reaction to which the electrode is applied. For example, the electrode coating substance suitable for use in electrolysis accompanied by oxygen generation includes platinum group metals, platinum group metal oxides, and mixed oxides of platinum group metal oxides and base metal oxides, or other metal oxides. Specific examples of these substances are Pt, Pt-Ir, Pt-$IrO_2$, Ir oxide, Ir oxide-Ru oxide, Ir oxide-Ti oxide, Ir oxide-Ta oxide, Ru oxide-Ti oxide, Ir oxide-Ru oxide-Ta oxide, Ru oxide-Ir oxide-Ti oxide, Ir oxide-Sn oxide, etc.

The method of forming the electrode coating is not particularly restricted, and any of known techniques, such as thermal decomposition, plating, electrochemical oxidation, powder sintering, and the like, may be employed. Such techniques are described in U.S. Pat. Nos. 3,632,498 and 3,711,385. In particular, the thermal decomposition technique in which a solution of a salt of a metal thermally decomposable is coated on a substrate followed by heating is preferable.

The present invention is now illustrated in greater detail by way of the following examples, but it should be understood that the present invention is not limited thereto.

EXAMPLE 1

A commercially available pure titanium plate having a length of 100 mm, a width of 50 mm, and a thickness of 3 mm was degreased with acetone, washed successively with a hot oxalic acid solution and pure water, and dried to prepare an electrode substrate.

Separately, a cerium chloride was dissolved in a 35 wt % hydrochloric acid solution to prepare a solution having a cerium ion concentration of 0.1 mol/l, and the solution was coated on the above prepared substrate with a brush. After drying, the coating was heated at 550° C. for 10 minutes for sintering. The coating and heating procedures were repeated until a first intermediate layer of $CeO_2$ having a coverage of 2 g of cerium per m$^2$ was formed.

Then, a solution of tantalum chloride and a solution of tin chloride were prepared, and a mixture of the two solutions was coated on the first intermediate layer, and the coating was thermally decomposed in the same manner as for the first intermediate layer to form a second intermediate layer comprising $Ta_2O_5$ and $SnO_2$ at a molar ratio ($Ta_2O_5/SnO_2$) of 1/5 and having a total coverage of tantalum and tin of 20 g/m$^2$.

A mixed hydrochloric acid solution containing a ruthenium chloride and iridium chloride was then coated on the second intermediate layer, and the coating was thermally decomposed in the same manner as described above to form an electrode active substance coating comprising $RuO_2$ and $IrO_2$ at a molar ratio ($RuO_2/IrO_2$) of 4/1. The electrode active substance coating contained 0.1 mg/cm$^2$ of the platinum group metals. The resulting electrode was designated as Sample A-1.

For comparison, an electrode was produced in the same manner as described above, except that only the second or the first intermediate layer was formed instead of the dual intermediate layers (Sample B-1 or C-1, respectively).

In order to evaluate durability of the electrode of this example, electrolysis was performed using each of the resulting electrodes as an anode and a platinum plate as a cathode in a 1M sulfuric acid aqueous solution at a temperature of 50° C. and at a current density of 1 $A/cm^2$. The time required for the electrolysis cell voltage reached 10 V was taken as durability.

As a result, the durability of the electrode according to the present invention (Sample A-1) was 24.1 hours, which was about 2.6 times longer than that of Sample B-1 (9.3 hours) and about 1.7 times longer than that of Sample C-1 (14.2 hours). It is apparent from these results that the electrode of this invention has markedly improved durability when used in electrolysis for oxygen generation.

EXAMPLE 2

In the same manner as described in Example 1, a Ti substrate was coated with a first intermediate layer comprising LaOCl having an La coverage of 1 $g/m^2$, a second intermediate layer comprising $TiO_2$ and LaOCl at a molar ratio ($TiO_2$/LaOCl) of ½ having a total coverage of Ti and La of 5 $g/m^2$, and an electrode active substance coating comprising $IrO_2$ having an Ir coverage of 0.1 $mg/cm^2$ in this order by thermal decomposition of a hydrochloric acid solution of the respective metal. The resulting electrode was designated as Sample A-2. For comparison, Samples B-2 or C-2 were produced in the same manner as for Sample A-2, except that only the second or first intermediate layer was formed, respectively, and Sample D-2 was produced in the same manner as for Sample A-2 except that neither of the first and second intermediate layers was formed.

Each of the resulting electrodes was evaluated for durability in the same manner as in Example 1, and the results obtained are shown in Table 1 below. It can be seen from the Table that the electrode in accordance with the present invention in which two intermediate layers are provided has markedly improved durability.

TABLE 1

| Sample No. | Substrate | First intermediate layer | Second intermediate layer | Electrode coating | Durability (hr) |
|---|---|---|---|---|---|
| A-2 | Ti | LaOCl | $TiO_2$—LaOCl | $IrO_2$ | 29.3 |
| B-2 | " | — | " | " | 12.1 |
| C-2 | " | LaOCl | — | " | 15.0 |
| D-2 | " | — | — | " | 9.2 |

EXAMPLE 3

Lanthanum nitrate was dissolved in 20 wt % nitric acid to prepare a 0.1 mol/l solution of lanthanum. The solution was coated on the same Ti substrate as used in Example 1 and sintered in 550° C. in air for 10 minutes to form a first intermediate layer of $La_2O_3$ having a lanthanum coverage of 8 $g/m^2$.

On the first intermediate layer were successively formed a second intermediate layer comprising $MnO_2$ having an Mn coverage of 10 $g/m^2$ and an electrode active coating comprising Pt-$IrO_2$-$RuO_2$-$SnO_2$ at a molar ratio of 1/1/2/7 by thermal decomposition using a hydrochloric acid solution of the respective metal to produce an electrode. The total coverage of the platinum metals in the electrode active coating was 0.1 $mg/cm^2$(hereinafter the same). The resulting electrode was designated as Sample A-3. For comparison, Samples B-3, C-3, or D-3 were produced in the same manner as for Sample A-3, except that only the second layer was formed; only the first layer was formed; or neither of the first and second intermediate layers was formed, respectively.

In order to evaluate durability of the electrode of the present invention, electrolysis was performed using each of the resulting electrodes as an anode and a platinum plate as a cathode in a 3 wt % sodium chloride aqueous solution at 10° C. and at a current density of 1 $A/dm^2$. The time required for the electrolysis cell voltage to reach 10 V was taken as indicating the durability. The results obtained are shown in Table 2 below.

TABLE 2

| Sample No. | Substrate | First intermediate layer | Second intermediate layer | Electrode coating | Durability (hr) |
|---|---|---|---|---|---|
| A-3 | Ti | $La_2O_3$ | $MnO_2$ | Pt—$IrO_2$—$RuO_2$—$SnO_2$ | 263.2 |
| B-3 | " | — | " | Pt—$IrO_2$—$RuO_2$—$SnO_2$ | 123.6 |
| C-3 | " | $La_2O_3$ | — | Pt—$IrO_2$—$RuO_2$—$SnO_2$ | 140.5 |
| D-3 | " | — | — | Pt—$IrO_2$—$RuO_2$—$SnO_2$ | 98.1 |

As is apparent from the results of Table 2, the durability of the electrode according to the present invention is about 2.1, about 1.9, or about 2.7 times longer than that of Sample B-3, C-3, or D-3, respectively.

EXAMPLES 4 TO 6

Electrodes having a $CeO_2$ coating as a first intermediate layer (Samples A-4, A-5, and A-6) were produced in the same manner as in Example 1, except for following the specifications shown in Table 3 below.

The second intermediate layer of Sample A-5 was formed as follows. The electrode substrate having the first intermediate layer was electroplated with tin to a thickness of 5 μm by using a plating solution containing 55 g of stannous sulfate, 100 g of sulfuric acid, 100 g of cresolsulfonic acid, 2 g of gelatin, and 1 g of β-naphthol per liter at a temperature of 25° C. and at a cathode current density of 2 $A/dm^2$, and the deposited Sn was oxidized by heating at 550° C. in air.

Comparative electrodes were produced in the same manner as for each of Samples A-4, A-5, and A-6, except that only the second intermediate layer was formed (Samples B-4 to B-6); only the first intermediate layer was formed (Samples C-4 to C-6); or neither of the first and second intermediate layers was formed (Samples D-4 to D-6).

Each of the resulting electrodes was evaluated in the same manner as in Example 1, and the results obtained are shown in Table 3 below. In the Table, the degree of improvement in durability was expressed in terms of the ratio of durability of Sample A-4, A-5, or A-6 to that of the corresponding comparative electrode.

TABLE 3

| Sample No. | Substrate | First intermediate layer (metal coverage: $g/m^2$) | Second intermediate layer (metal coverage: $g/m^2$) | Electrode coating (molar ratio) | Durability (hr) | Ratio of durability: Over Sample B | Over Sample C | Over Sample D |
|---|---|---|---|---|---|---|---|---|
| A-4 | Ti | $CeO_2$ (4) | $SiO_2$—$Nb_2O_5$ (1/1) (2) | $IrO_2$—$Co_3O_4$ (9/1) | 35.2 | 2.8 | 1.9 | — |
| A-5 | Ti | $CeO_2$ (3) | $SnO_2$/Sn | Pt—$IrO_2$—$HfO_2$—$TiO_2$ | 28.9 | 2.4 | 3.8 | 9.6 |

TABLE 3-continued

| Sample No. | Substrate | First intermediate layer (metal coverage: g/m²) | Second intermediate layer (metal coverage: g/m²) | Electrode coating (molar ratio) | Durability (hr) | Ratio of durability Over Sample B | Over Sample C | Over Sample D |
|---|---|---|---|---|---|---|---|---|
| A-6 | Ti—12Mo—6Sn | $CeO_2$ (6) | $MoO_3$ (6) | (1/2/2/5) Pt | 8.8 | 2.1 | 1.6 | 2.8 |

EXAMPLES 7 TO 10

In a similar manner to that in Example 1, Samples A-7 to A-10 were produced according to the specifications shown in Table 4 below. Corresponding comparative electrodes (Samples B-7 to B-10, C-7 to C-10, and D-7 to D-10) were also produced in accordance with the same instructions as in the foregoing examples. The durability of the electrodes was evaluated by performing electrolysis using each of the electrodes as an anode and a platinum plate as a cathode in a 3 wt % sodium chloride aqueous solution at a temperature of 10° C. and at a current density of 1 A/cm². The time required for the electrolysis cell voltage to reach 10 V was taken as durability. The results obtained are shown in Table 4.

In Sample A-10, a Ti plate with its surface having been subjected to nitriding treatment so as to have a nitride layer of 3 μm in thickness was used as an electrode substrate; the molar ratio of $Sc_2O_3$ to $CeO_2$ in the first intermediate layer was 1/3; and the electrode coating comprising Pt, Pd, and Ir was formed by heating the coating in a reductive atmosphere at 550° C. under a hydrogen stream.

TABLE 4

| Sample No. | Substrate | First intermediate layer (metal coverage: g/m²) | Second intermediate layer (metal coverage: g/m²) | Electrode coating (molar ratio) | Durability (hr) | Ratio of durability Over Sample B | Over Sample C | Over Sample D |
|---|---|---|---|---|---|---|---|---|
| A-7 | Ti | $Y_2O_3$ (4) | $Fe_2O_3$ (6) | $RuO_2$—$IrO_2$—$SnO_2$ (2/1/7) | 224.0 | 2.2 | 1.3 | 2.2 |
| A-8 | Ti | $Sc_2O_3$ (1) | $In_2O_3$ (2) | $IrO_2$—$SnO_2$ (3/10) | 284.9 | 2.8 | 2.1 | 1.7 |
| A-9 | Ti | $CeO_2$ (2) | $SnO_2$ (15) | $IrO_2$—$SnO_2$ (3/10) | 301.1 | 1.6 | 1.8 | — |
| A-10 | TiN/Ti | $Sc_2O_3$—$CeO_2$ (3) | $Nb_2O_5$ (10) | Pt—Pd—Ir (1/1/1) | 250.3 | 1.9 | 1.5 | 2.2 |

As described above, according to the present invention in which a first intermediate layer comprising at least one compound of rare earth element and a second intermediate layer containing at least one of base metals and oxides thereof are formed between an electrode substrate and an electrode active substance coating, passivation resistance and durability of electrodes can be greatly improved. Therefore, the durable electrodes of the present invention are particularly suitable for use in electrolysis accompanied by oxygen generation or organic electrolysis.

While the invention has been described in detail and with reference to specific embodiments thereof, it will be apparent to one skilled in the art that various changes and modifications can be made therein without departing from the spirit and scope thereof.

What is claimed is:

1. An electrode for electrolysis comprising an electrode substrate made of a conductive metal having coated thereupon: a first intermediate layer comprised of at least one compound of rare earth element; a second intermediate layer containing at least one of base metals and base metal oxides; and on the substrate having the first and second intermediate layers, a coating of electrode active substance with electrochemical activities containing of a platinum group metal or an oxide thereof.

2. An electrode for electrolysis as in claim 1, wherein said conductive metal is selected from the group consisting of Ti, Ta, Nb, Zr, and an alloy based on said metals.

3. An electrode for electrolysis as in claim 1, wherein said electrode substrate is a conductive metal having been subjected to nitriding, boriding, or carbiding treatment.

4. An electrode for electrolysis as in claim 1, wherein said compound of rare earth element is an oxide or oxyhalide of a metal selected from the group consisting of Sc, Y, La, Ce, Nd, Sm, and Gd.

5. An electrode for electrolysis as in claim 1, wherein said base metal or oxide thereof is selected from the group consisting of Ti, Ta, Nb, Zr, Hf, W, V, Al, Si, Sn, Pb, Bi, Sb, Ge, In, Ga, Fe, Mo, Mn, and

6. A process for producing an electrode for electrolysis which comprises coating an electrode substrate made of a conductive metal with a first intermediate layer comprised of at least one compound of rare earth element; a second intermediate layer containing at least one of base metals and base metal oxides; and on the substrate having the first and second intermediate layers, a coating of electrode active substance with electrochemical activities containing a platinum group metal or an oxide thereof.

7. A process as in claim 6, wherein said conductive metal is selected from the group consisting of Ti, Ta, Nb, Zr, and an alloy based on said metals.

8. A process as in claim 6, wherein said electrode substrate is conductive metal having been subjected to nitriding, boriding, or carbiding treatment.

9. A process as in claim 6, wherein said coating of the first intermediate layer, the second intermediate layer, or the electrode active substance is carried out by thermal decomposition.

* * * * *